United States Patent [19]

Wilkinson

[11] 4,063,640

[45] Dec. 20, 1977

[54] MERCHANDISE PACKAGE

[75] Inventor: Michael T. Wilkinson, Memphis, Tenn.

[73] Assignee: Combustion and Controls Company, Inc., Memphis, Tenn.

[21] Appl. No.: 775,918

[22] Filed: Mar. 9, 1977

[51] Int. Cl.[2] ..... B65D 71/00

[52] U.S. Cl. ..... 206/231; 206/471; 206/495

[58] Field of Search ..... 206/231, 303, 471, 478, 206/484, 495, 497, 524.8, 525, 526

[56] References Cited

U.S. PATENT DOCUMENTS

| | | | |
|---|---|---|---|
| D. 177,651 | 5/1956 | Stubbs | 206/471 X |
| 2,127,578 | 8/1938 | Wyman | 206/303 |
| 2,886,172 | 5/1959 | Hodges | 206/231 |
| 3,202,280 | 8/1965 | Larson | 206/471 |
| 3,292,339 | 12/1966 | Esty | 206/484 X |

*Primary Examiner*—Herbert F. Ross

*Attorney, Agent, or Firm*—John R. Walker, III

[57] ABSTRACT

A merchandise package for containing the right size and number of bolts and nuts and a gasket for a flange connection to be used in water, air, gas and steam services. The package includes a substantially rigid plate-like member onto which a substantially flat gasket and a plurality of bolts and nuts are secured. Each of the plurality of nuts is threadingly attached to one of the plurality of bolts and the unit so produced is positioned on the plate-like member with the head of the bolt and with the nut positioned one on either side of a portion of the gasket so as to cause a portion of each bolt to form a bridge over the portion of the gasket.

10 Claims, 3 Drawing Figures

MERCHANDISE PACKAGE

DESCRIPTION OF THE PRIOR ART

1. Field of the Invention

This invention relates generally to packages and the like for holding and protecting merchandise and more specifically to a merchandise package for providing the necessary bolts, nuts and gaskets for a flange connection to be used in water, air, gas and steam services.

2. Description of the Prior Art

Heretofore, various packages have been developed to hold and protect merchandise. For example, Maynard, U.S. Pat. No. 2,876,899, discloses a package in which merchandise is mounted on a relatively stiff support card with a single film-type sheet, forming an impervious transparent protective cover extending over the merchandise in a shape-conforming engagement therewith and adherently connected to the card. Larson, U.S. Pat. No. 3,202,280, discloses a package in which a plurality of spaced-apart articles are mounted on a flat cardboard member and a transparent film is moulded about each of the articles to fix the articles in position on the cardboard member with the transparent film being attached to the cardboard member only around the outer edges thereof. Fineman et al, U.S. Pat. No. 3,326,372 discloses a package comprising a celuloid acetate facing fixedly adhering about an article which is in turn held by the facing against a somewhat stiff paperboard base. Cosier et al, U.S. Pat. No. 3,756,399 discloses a method of packaging an article having irregular protrusions on one side by first positioning the article on a backing member with the protrusions facing outward from the backing member, and placing a relatively cool inner sheet of thermoplastic film over the outward-facing side of the article, and finally placing a heated outer sheet of thermoplastic film over the inner sheet and applying a vacuum to the opposite side of the backing member to draw the two sheets of thermoplastic film into tight-fitting relationship with respect to the article and to draw the heated outer sheet into engagement with portions of the backing member whereby the heated outer sheet bonds to the cool inner sheet and to the backing member. None of the above patents disclose or suggest the present invention.

The present practice is obtaining the necessary parts for connecting a flange-type end of a water, air, gas or steam pipe or the like to another flange-type end of another pipe or the like is to separately obtain a gasket of the right size for placement between the two-flange type ends, a plurality of bolts of the right size for passing through the two flangetype ends, and a plurality of nuts of the right size for being threadingly attached to the bolts so as to tighten the two flange-type ends together. Commonly, these separate components are kept in different locations and must be obtained by way of separate orders, requisitions, claims or the like. Also, the gaskets are normally constructed of asbestos or the like and are, therefore, fragile and are susceptible to being easily and inadvertently damaged.

SUMMARY OF THE INVENTION

The present invention is directed towards overcoming the problems and disadvantages of prior ways of obtaining the necessary parts for connecting the flange-type end of a water, air, gas or steam pipe or the like to another flange-type end of another pipe or the like. The concept of the present invention is to provide a single package containing the gasket for water, air, gas or steam services complete with the correct number and size of bolts and nuts for a flange connection.

The merchandise package of the present invention includes, in general, a substantially rigid plate-like means; a substantially flat gasket means positioned on the plate-like means; a plurality of bolt means positioned on the plate-like means, each of the plurality of bolt means including a bolt member and a nut member threadingly attached to the bolt member, the bolt member having a head portion, each of the plurality of bolt means being positioned on the plate-like means with the nut member and the head portion of the bolt member being positioned one on either side of a portion of the gasket means so as to form a bridge thereover; and means for fixedly securing the gasket means and plurality of bolt means to the plate-like means.

DESCRIPTION OF THE PREFERRED EMBODIMENT

The merchandise package 11 of the present invention provides all the merchandise needed for a flange connection in one package. The merchandise package 11 includes, in general, a plate-like means 13, a gasket means 15, a plurality of bolt means 17, and means for fixedly securing the gasket means 15 and the plurality of bolt means 17 to the plate-like means 13.

Figure 1:
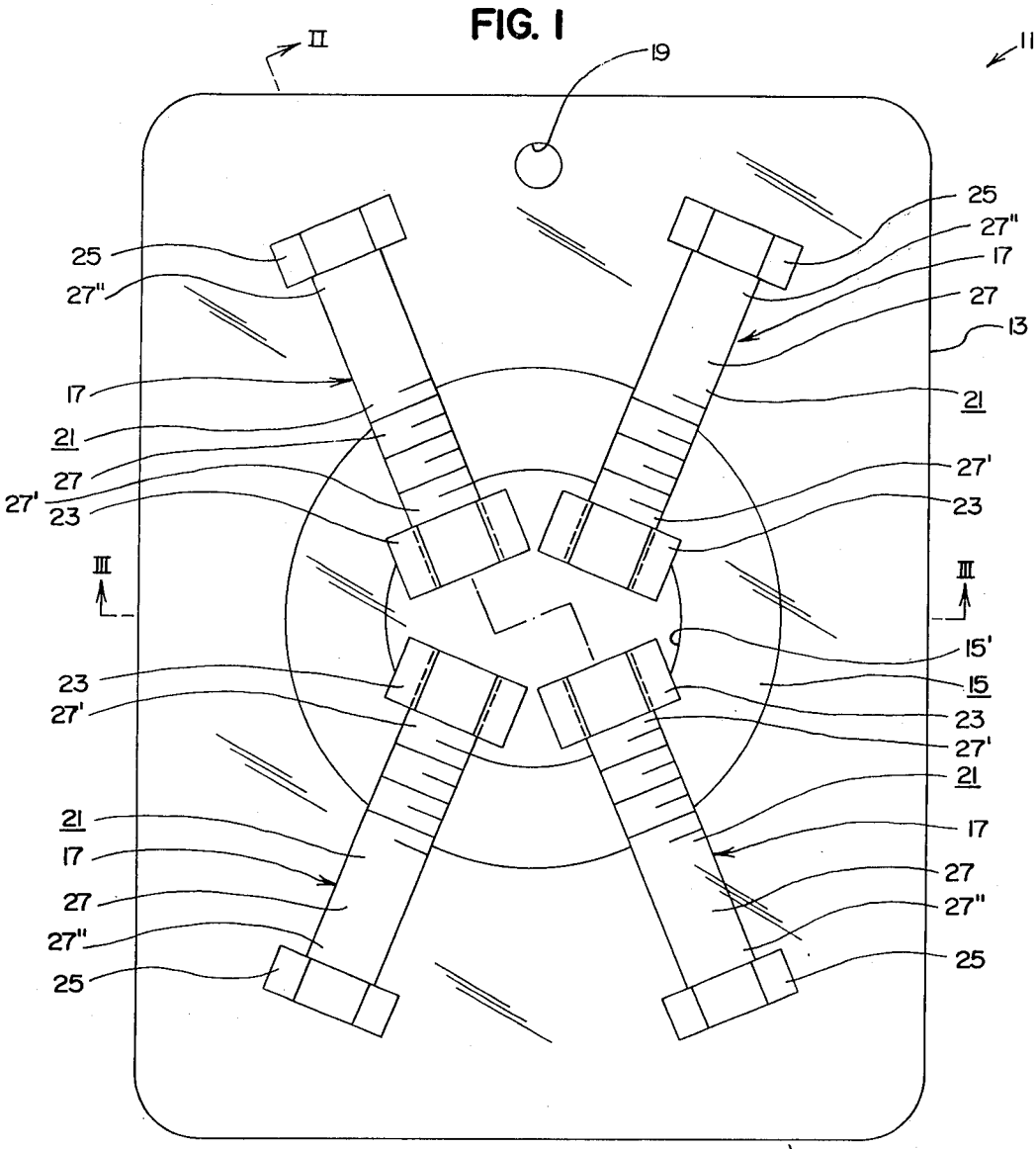
FIG. 1 is a top plan view of the merchandise package of the present invention.
Figure 3:
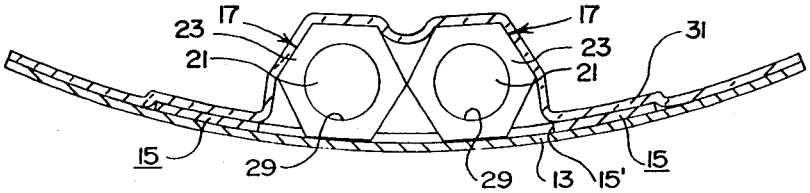
FIG. 3 is a sectional view thereof substantially as taken on line III—III of FIG. 1 but showing the present invention in a moved position.

The plate-like means 13 is substantially rigid so as to normally maintain a flat, substantially plate-like shape but is flexible enough so as to bend when sufficient pressure is applied thereto as shown in FIG. 3. The plate-like means 13 is preferably constructed of paper, cardboard or other fiberous sheet material and may be constructed in a square or rectangular shape as shown in FIG. 1. The plate-like means 13 may be provided with an aperture 19 located adjacent the upper edge thereof for allowing the merchandise package 11 to be hung on a peg board or the like.

Figure 2:
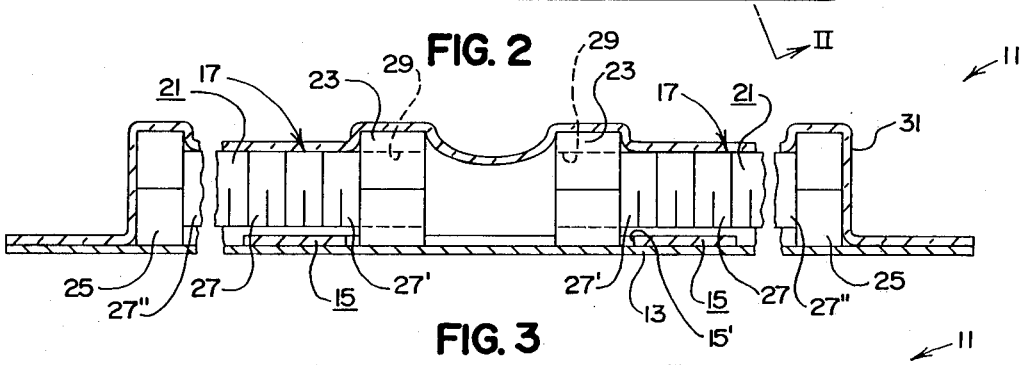
FIG. 2 is a sectional view thereof as taken on line II—II of FIG. 1 with some portions thereof broken away for clarity.

The gasket means 15 is preferably positioned flat on the plate-like means 13 as shown in FIGS. 1, 2 and 3. The gasket means 15 is preferably substantially flat as shown in FIG. 2 and is provided with an aperture 15' substantially through the center thereof as shown in FIGS. 1, 2 and 3. Preferably, the gasket means 15 is substantially annular or ring-shaped as clearly shown in FIG. 1. The gasket means 15 may be constructed out of asbestos or any other well-known gasket material.

Each of the plurality of bolt means 17 is positioned on the plate-like means 13 as shown in FIGS. 1, 2 and 3. Each of the plurality of bolt means 17 includes a bolt member 21 and a nut member 23 for being threadingly attached to the bolt member 21 as shown in the drawings. The bolt member 21 has a head portion 25. Each bolt member 21 preferably has an elongated body portion 27 having a threaded first end 27' and having a second end 27'' fixedly attached to the head portion 25 substantially centrally thereof. Each of the nut members 23 preferably has a threaded aperture 29 therethrough for threadingly coacting with the threaded first end 27' of the body member 27 of each bolt member 21. The nut member 23 and the head portion 25 of the bolt member 21 of each of the plurality of bolt means 17 preferably have at least one flat surface thereto as clearly shown in FIG. 3 for resting on the plate-like means 13. More specifically, the nut member 23 and the head portion 25 of the bolt member 21 of each of the plurality of bolt means 17 are preferably hexagon-shaped so as to have six flat surfaces thereto.

The head portion 25 of the bolt member 21 and the nut member 23 are preferably located substantially concentric with the longitudinal axis of the body portion 27 of the bolt member 21 and are preferably larger is cross-sectional or diameter than the body portion 27 of the bolt member 21 as can be clearly seen in FIGS. 1, 2 and 3 so that the body portion 27 of the bolt member 21 is held spaced above the plate-like means 13 when the plurality of bolt means 17 is positioned thereon. Each of the plurality of bolt means 17 is preferably positioned with the longitudinal axis of the body portion 27 thereof extending radially outwards of the center of the ring-shaped gasket means 15 as shown is FIG. 1 and with the nut member 23 and the head portion 25 of the bolt member 21 thereof positioned one on either side of a portion of the gasket means 15 so as to form a bridge thereover as shown in FIG. 2. More specifically, each of the plurality of bolt means 17 is preferably positioned on the plate-like means 13 with the nut member 23 positioned within the aperture 15' of the gasket means 15 and with the head portion 25 of the bolt member 21 positioned outside of the gasket means 15 as shown in FIG. 1. Additionally, the plurality of bolt means 17 are preferably positioned so that when the plate-like means 13 is bent inwardly as shown in FIG. 3, the nut members 23 of each of the plurality of bolt means 17 will engage one another to prevent the plate-like means 13 from being bent inwardly more than a certain amount as shown in FIG. 3 to thereby prevent the gasket means 15 from being inadvertently damaged by being bent inwardly too far.

The means for fixedly securing the gasket means 15 and the plurality of bolt means 17 to the plate-like means 13 preferably includes a substantially flexible, transparent cover means 31 for extending over the gasket means 15 and the plurality of bolt means 17 and for being fixedly attached to the plate-like means 13. The cover means 31 is preferably a thin sheet of transparent plastic or the like and may be fixedly attached to the plate-like means 13 in any manner apparent to those skilled in the art such as by being glued thereto or the like.

As thus constructed, the present invention provides a substantially rust resistant merchandise package which contains all the merchandise necessary in connecting two flangelike portions together in a manner well known to those skilled in the art. The merchandise package 11 of the present invention provides a unique method of packaging bolts with nuts in place thereon so as to provide protection for a gasket during shipment and at the job site. The merchandise package 11 is advantageous in that it prevents loss or misplaced pieces of the plurality of parts needed to join two flange-like portions together, does away with time spent measuring bolts, nuts and gaskets to obtain the correct parts and provides a single source of supply for all the merchandise needed to join two flange-like portions together.

Although the invention has been described and illustrated with respect to a preferred embodiment thereof, it is not to be so limited since changes and modifications may be made therein which are within the full intended scope of the invention.

I claim:

1. A merchandise package comprising:
   a. a substantially rigid plate-like means;
   b. a substantially flat gasket means positioned flat on said plate-like means;
   c. a plurality of bolt means positioned on said plate-like means, each of said plurality of bolt means including a bolt member and a nut member threadingly attached to said bolt member, said bolt member having a head portion, each of said plurality of bolt means being positioned flat on said plate-like means with said nut member and said head portion of said bolt member in contact with said plate being positioned one on either side of a portion of said gasket means so as to form a bridge thereover; and
   d. means for fixedly securing said gasket means and said plurality of bolt means to said plate-like means.

2. The merchandise package of claim 1 in which said gasket means has an aperture therethrough and in which each of said plurality of bolt means is positioned on said platelike means with said nut member positioned on said plate-like means with said nut member positioned within said aperture of said gasket means and with said head portion of said bolt member positioned outside of said gasket means.

3. The merchandise package of claim 2 in which said bolt member of each of said plurality of bolt means includes a substantially elongated body portion flat having a threaded first end and having a second end, in which said head portion of body member of each of said plurality of bolt means is fixedly attached to said second end of said body portion, in which said nut member of each of said plurality of bolt means has a substantially centrally located threaded aperture therethrough for threadingly coacting with said threaded first end of said body portion flat of said bolt member, and in which said head portion flat of said bolt member in contact with said plate-like means and said nut member are substantially concentric with the longitudinal axis of said body portion of said bolt means and are larger in cross-sectional area than said body portion of said bolt member so that said body portion of said bolt member is held spaced above said plate-like means.

4. The merchandise package of claim 3 in which said gasket means is substantially ring-shaped and in which each of said plurality of bolt means is positioned with the longitudinal axis of said body portion of each of said bolt members extending radially outwards of the center of said ring-shaped gasket means.

5. The merchandise package of claim 4 in which said plurality of bolt means are positioned so that when said plate-like means is bent inwardly, said nut members of said plurality of bolt means will engage one another to prevent said plate-like means from being bent inwardly more than a certain amount.

6. The merchandise package of claim 5 in which said means for fixedly securing said gasket means and said plurality of bolt means to said plate-like means includes a substantially flexible, transparent cover means for extending over said gasket means and said plurality of bolt means and for being fixedly attached to said plate-like means.

7. A merchandise package comprising:
   a. a substantially rigid plate-like means;

b. substantially flat gasket means positioned flat on said plate-like means substantially centrally thereof, said gasket means having an aperture through substantially the center thereof;

c. a plurality of bolt means positioned on said plate-like means, each of said bolt means including a bolt member and a nut member threadingly attached to said bolt member, said bolt member including a substantially elongated body portion having a threaded first end and a second end and including a head portion fixedly attached to said second end of said body portion, said nut member having a substantially centrally located threaded aperture therethrough for threadingly coacting with said threaded first end of said body portion of said bolt member, each of said bolt means being positioned with said nut member thereof positioned within said aperture through said gasket means and with said head portion of said bolt member thereof being positioned outside of said gasket means and with said body portion of said bolt member extending over a portion of said gasket means so as to form a bridge thereover, said head portion of said bolt member and said nut member being substantially concentric with the longitudinal axis of said body portion of said bolt means and being larger in cross-sectional area than said body portion of said bolt member so that said body portion of said bolt member is held above the portion of said gasket means which it extends over; and d. a substantially flexible cover means for extending over said gasket means and said plurality of bolt means and for being fixedly attached to said plate-like means to fixedly secure said gasket means and said plurality of bolt means to said plate-like means.

8. The merchandise package of claim 7 in which said gasket means is substantially ring-shaped and in which each of said plurality of bolt means is positioned with said body portion of each of said bolt members extending radially outward of the center of said ring-shaped gasket means.

9. The merchandise package of claim 8 in which said plurality of bolt means are positioned so that when said plate-like member is bent inwardly, said nut member of said plurality of bolt means will engage one another to prevent said plate-like member from being bent inwardly more than a certain amount.

10. The merchandise package of claim 7 in which said cover means is transparent.

* * * * *